US008471791B2

(12) United States Patent
Zommer et al.

(10) Patent No.: US 8,471,791 B2
(45) Date of Patent: Jun. 25, 2013

(54) VIDEO AND CONTENT CONTROLLED BACKLIGHT

(75) Inventors: Nathan Zommer, Fort Lauderdale, FL (US); Sam Seiichiro Ochi, Saratoga, CA (US)

(73) Assignee: IXYS Corporation, Milpitas, CA (US)

( * ) Notice: Subject to any disclaimer, the term of this patent is extended or adjusted under 35 U.S.C. 154(b) by 0 days.

(21) Appl. No.: 11/838,768

(22) Filed: Aug. 14, 2007

(65) Prior Publication Data

US 2008/0036398 A1 Feb. 14, 2008

Related U.S. Application Data

(60) Provisional application No. 60/837,710, filed on Aug. 14, 2006.

(51) Int. Cl.
*G09G 3/32* (2006.01)

(52) U.S. Cl.
USPC ..... 345/82; 345/83; 345/690; 315/307

(58) Field of Classification Search
USPC ..... 345/76–104, 204–215; 39/44; 250/552
See application file for complete search history.

(56) References Cited

U.S. PATENT DOCUMENTS

| | | | |
|---|---|---|---|
| 4,199,774 | A | 4/1980 | Plummer |
| 4,532,534 | A | 7/1985 | Ford et al. |
| 4,639,762 | A | 1/1987 | Neilson et al. |
| 4,860,072 | A | 8/1989 | Zommer |
| 4,881,106 | A | 11/1989 | Barron |
| 4,959,699 | A | 9/1990 | Lidow et al. |
| 5,089,864 | A | 2/1992 | Sakuri |
| 5,187,555 | A | 2/1993 | Kuroda et al. |
| 5,217,916 | A | 6/1993 | Anderson et al. |
| 5,229,629 | A | 7/1993 | Koike |
| 5,237,481 | A | 8/1993 | Soo et al. |
| 5,497,014 | A | 3/1996 | Momose |
| 5,557,127 | A | 9/1996 | Ajit et al. |
| 5,631,484 | A | 5/1997 | Tsoi et al. |
| 5,712,502 | A | 1/1998 | Mitlehner et al. |

(Continued)

FOREIGN PATENT DOCUMENTS

| | | |
|---|---|---|
| CN | 2310926 Y | 3/1999 |
| CN | 170273 | 11/2005 |

(Continued)

OTHER PUBLICATIONS

Office Action of Sep. 24, 2004 for U.S. Appl. No. 10/790,983, 8 pages.

(Continued)

*Primary Examiner* — Kevin M Nguyen
*Assistant Examiner* — Kenneth B Lee, Jr.

(57) ABSTRACT

A display device includes a display panel; and a backlight panel provided below the display panel and defining a plurality of regions. A first array of light emitting diodes (LEDs) is provided along a first direction, each LED of the first array being coupled to a first line. A driver is coupled to the first line to drive the LEDs coupled to the first line. A second array of LEDs is provided along a second direction, each LEDs of the second array being coupled to a second line. A lighting condition of the regions defined by the backlight panel is controlled by turning on or off the LEDs.

11 Claims, 8 Drawing Sheets

U.S. PATENT DOCUMENTS

| | | | | |
|---|---|---|---|---|
| 5,812,105 | A * | 9/1998 | Van de Ven | 345/83 |
| 5,917,207 | A | 6/1999 | Colwell et al. | |
| 5,973,376 | A | 10/1999 | Rostoker et al. | |
| 6,002,153 | A | 12/1999 | Tsunoda et al. | |
| 6,140,184 | A | 10/2000 | Dupuy et al. | |
| 6,614,684 | B1 | 9/2003 | Shukuri et al. | |
| 6,710,405 | B2 | 3/2004 | Zommer et al. | |
| 7,110,069 | B2 | 9/2006 | Kang et al. | |
| 7,317,403 | B2 * | 1/2008 | Grootes et al. | 340/815.45 |
| 7,460,103 | B2 | 12/2008 | Konno et al. | |
| 7,554,625 | B2 | 6/2009 | Koganezawa | |
| 2004/0218388 | A1 | 11/2004 | Suzuki et al. | |
| 2005/0001537 | A1 | 1/2005 | West et al. | |
| 2005/0052376 | A1 * | 3/2005 | Shivji | 345/82 |
| 2005/0122294 | A1 * | 6/2005 | Ben-David et al. | 345/87 |
| 2005/0128374 | A1 | 6/2005 | Furukawa | |
| 2005/0156558 | A1 | 7/2005 | Kang et al. | |
| 2005/0265029 | A1 * | 12/2005 | Epstein et al. | 362/339 |
| 2006/0002107 | A1 | 1/2006 | Jeong | |
| 2006/0007103 | A1 | 1/2006 | Oh et al. | |
| 2006/0056201 | A1 | 3/2006 | Change et al. | |
| 2006/0066783 | A1 * | 3/2006 | Sampsell | 349/114 |
| 2007/0284600 | A1 * | 12/2007 | Shchekin et al. | 257/98 |

FOREIGN PATENT DOCUMENTS

| | | | |
|---|---|---|---|
| EP | 0778620 | A2 | 6/1997 |
| EP | 0778620 | A3 | 6/1997 |
| JP | 09-129878 | A | 5/1997 |
| JP | 2000-231107 | A | 8/2000 |
| JP | 2004-145168 | A | 5/2004 |
| JP | 2005-258403 | A | 9/2005 |
| JP | 2005-339822 | A | 12/2005 |
| JP | 2006134661 | A | 5/2006 |
| WO | WO 96/03774 | A1 | 2/1996 |
| WO | WO2004/079437 | A1 | 9/2004 |

OTHER PUBLICATIONS

Office Action of May 19, 2005 for U.S. Appl. No. 10/790,983, 8 pages.
Office Action of Oct. 11, 2005 for U.S. Appl. No. 10/790,983, 12 pages.
Office Action of May 4, 2006 for U.S. Appl. No. 10/790,983, 5 pages.
Office Action of Oct. 2, 2002 for U.S. Appl. No. 09/764,545, 5 pages.
Office Action of Dec. 2, 2002 for U.S. Appl. No. 09/764,545, 10 pages.
Office Action of May 22, 2003 for U.S. Appl. No. 09/764,545, 18 pages.
Office Action of Dec. 8, 2003 for U.S. Appl. No. 09/764,545, 3 pages.
Supplementary European Search Report of Apr. 4, 2008 for European Patent Application No. EP02733780, 2 pages.
International Search Report and Written Opinion of Aug. 20, 2008 for Patent Application No. PCT/US2007/075928, 6 pages.
European Search Report for EP07840951 (Jan. 26, 2011).
Office Action from China Intellectual Property Office for application CN200780030013.1 (Jan. 26, 2011).
Office Action from China Intellectual Property Office for application CN200780030013.1 (May 9, 2012).
Office Action from China Intellectual Property Office for application CN200780030013.1 (Jan. 29, 2012).
Japan Patent Office Office Action dated for application JP2009-524771 (Mar. 19, 2012).
European Patent Office Examination Report for European Patent Application EP07840951.3 (Sep. 24, 2012).
Office Action from China Intellectual Property Office for application CN200780030013.1 (Oct. 17, 2012).
Japan Patent Office Office Action dated for application JP2009-524771 (Dec. 12, 2012).

* cited by examiner

VIDEO AND CONTENT CONTROLLED BACKLIGHT

CROSS-REFERENCES TO RELATED APPLICATIONS

The present application claims benefit of U.S. Provisional Application No. 60/837,710, filed on Aug. 14, 2006, which is incorporated by reference.

BACKGROUND OF THE INVENTION

The present invention relates to a display device and a backlight component thereof.

Liquid crystal displays ("LCDs") contain a backlight, which is the source of light that enables the LCDs to display images and texts. The liquid crystal that is in the display acts as a shutter to let the light through or not based on the command that is delivered by a corresponding control chip. Most LCDs use a cold cathode fluorescent light ("CCFL") tube as the light source. CCFL is on all the time when the LCD is turned on. The video signal, or the content, or the image that is shown on the LCD is created by the controlling the orientation of the liquid crystal elements in the display panel.

The special glass panel of the LCD creates the colors based on the light filtering mechanism of the films on the glass panel. The light that is generated by the CCFL is white light in most of the LCDs, which is provided behind the glass panel, where the front side is the side of the viewer.

CCFL is energy efficient. However due to the use of hazardous materials in CCFL, the industry is phasing out CCFL from the backlight application. Also the CCFL-based backlight is kept turned on continuously even if no image is displayed. Furthermore the light is slow to turn on or off, thus it is difficult to switch it on or off based on the image.

However, it would be desirable to turn the backlight off if no image is being displayed, or for dark scene, or for a dark image. This would save energy, which would especially beneficial for battery operated portable products. Furthermore the CCFL backlight lights the back of the whole display and has difficulty in providing zone backlighting, or fractional backlighting based on the image to be displayed. Namely if on one side of the display the image is a dark image, than that side does not need the backlight on. With CCFL technology it is difficult to only light the needed area or zone, and especially at video image rate (30 to 60 frames a second) sine CCFL cannot be turned on or off at fast rates.

Alternatively the industry has been embracing the use of white light emitting diodes, ("LEDs") for backlights. Rather than having a CCFL light bulb, one uses a plurality of LEDs as the light source. However this solution is more costly than present CCFL backlights. The LED backlighting is also less energy efficient than the CCFL light source. Also the present so-called "white LEDs" do not emit pure white light, nor is it as white as the CCFL based backlight. Namely the white color is not truly optically white thus the resultant color quality of the image is poor. This LED solution might be adequate for LCDs for simple telephones, or instruments that do not need to display color pictures, or video, or television, ("TV") programs. However for LCD for color TVs, video displays, and for color imagery, a better solution is needed.

With this need the industry has resorted to the use of RGB LED technology, namely LED's with the three distinct colors, red green and blue (similar to the RGB concept in the CRT color TVs). According to color physics, one can generate for the human eye, the colors of the spectrum with the combinations of RGB. For example, white is created by turning on the three colors at the desired intensity, the red green and blue, which then appears to the eye as white. These techniques are well known for persons trained in the art, from the early days of CRT based color TV and color art graphics.

BRIEF SUMMARY OF THE INVENTION

The present invention relates to display devices, e.g., LCDs, using light emitting diodes. Current LCD panels commonly use CCFL technology. Generally, such LCDs use three primary colors (red, green, and blue) per pixel with no precise control on the brightness. Only an overall brightness control is possible by adjusting the CCFL backlight intensity. However, among other features, the present invention teaches the use of LEDs in the display devices. This enablers the separation of image contrast from image color and brightness. Image contrast can be fully controlled by the LCD panel acting as a simple off-on light shutter. A single off-on LCD light shutter pixel can control three colors using the LEDBK. More specifically, a single LCD light shutter pixel, which happen to be located in an area lit up by LED cluster can control red, green, blue, or any color simply by adjusting the IRed Ym, IGreen Ym, or IBlue Ym (see FIG. 5). LCD panel thus used in conjunction with the LEDBK increases the total number of pixels controlled by three. In addition, varying the individual LED current varies the brightness.

By using the LCD displays as simple off-on light shutters per pixel, and by using the LEDBK to provide the needed colors, the LEDBK of the present embodiment increases the resolution of LCD panels by a factor of three. By increasing the LEDBK light output in panel areas needing bright light, and by reducing the LED current or turning off the LEDs in areas needing low light or darkness, the contrast of the LCD is increased. By only turning on the LEDs in areas where light output is needed, energy efficiency is increased.

In one embodiment, a display device includes a display panel; and a backlight panel provided below the display panel and defining a plurality of regions. A first array of light emitting diodes (LEDs) is provided along a first direction, each LED of the first array being coupled to a first line. A driver is coupled to the first line to drive the LEDs coupled to the first line. A second array of LEDs is provided along a second direction, each LEDs of the second array being coupled to a second line. A lighting condition of the regions defined by the backlight panel is controlled by turning on or off the LEDs. The plurality of regions define a matrix of regions having an X number of rows and a Y number of columns. Each region has at least one LED. Each region has at least one LED cluster.

In another embodiment, an array of light emitting diodes (LEDs) includes a first array of light emitting diodes (LEDs) provided along a first direction in a backlight panel of a display device, each LED of the first array being coupled to a first line; a driver coupled to the first line to drive the LEDs coupled to the first line; and a second array of LEDs provided along a second direction, each LEDs of the second array being coupled to a second line, wherein the LEDs are grouped in a cluster of at least three LEDs.

DETAILED DESCRIPTION OF THE INVENTION

The present invention relates to the use of LEDs in a display device, e.g., LCDs. In one embodiment, an array of LED modules or clusters are used as a backlight of the LCD. Each of these module or cluster comprises a plurality of LEDs of RGB that is suitable for generating white light. In one implementation, the module or cluster comprises RGBB (an extra blue LED in the cluster), or RGBYC (which in addition to the red green and blue, has a yellow and cyan LED), or RGBXYZ, where X is an additional color LED, Y is an additional color LED and Z is an additional color LED in a cluster. Based on the specific application, or specific use of the display, either for TV, or still photography, or display of art, one can select any LED combination in a cluster. For simplicity of the explanation, without limiting it to the discussed example, the present invention is described in using RGB LED clusters.

Figure 1:
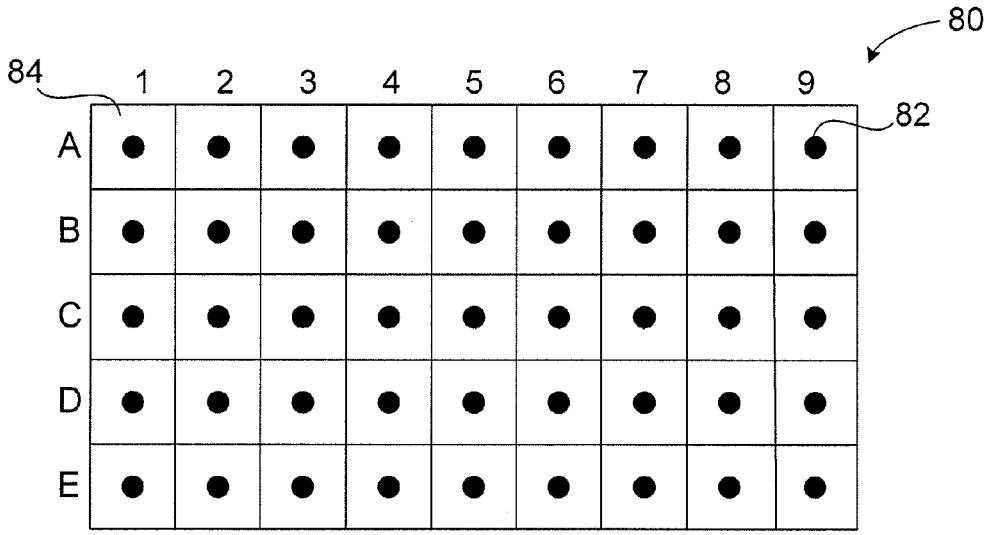
FIGS. 1 and 2 illustrate an LED based a backlighting panel and a liquid crystal panel according to one embodiment of the present invention.
Figure 2:
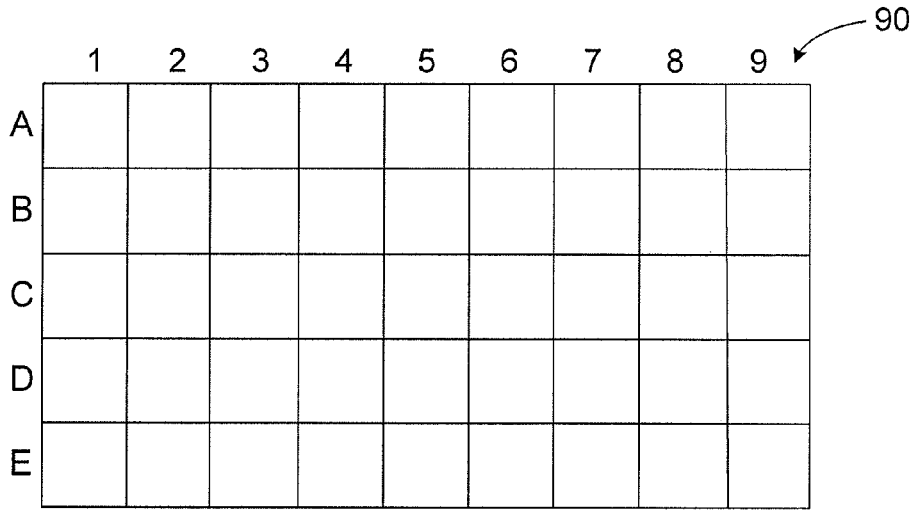

FIGS. 1 and 2 illustrate an LED based a backlighting panel 80 and a liquid crystal panel 90 according to one embodiment of the present invention. The LC panel 90 is divided into a plurality of regions, e.g., 9 by 5. Similarly, the LED backlight panel 80 ("LEDBK") corresponding to the LC panel 90 is divided into a plurality of regions, e.g., 9 by 5. An RGB LED cluster 82 is provided in each region of the LEDBK 80. In one implementation, an white LED may be used in place of an LED cluster for each region. In another implementation, an LED is cluster is not placed at each region, but at selected locations.

Each region is designated by X-Y coordinates. A top left region 84 is designated by X-Y coordinates as A1. The region A1 in the LEDBK corresponds to a region A1 in the LC panel. Similarly, each region in the LEDBK is assigned the same coordinates as the corresponding region in the LC panel. A display panel is formed by putting the LC panel 90 on top of the LED backlight panel 80, thereby forming one LCD.

In the present embodiment, the LEDBK 90, includes one RGB LED cluster per region. Each region of the LC panel, however, may include one or more pixels. Each LCD pixel element is driven by the corresponding LCD driver element. The driver elements are chips that couple with transistors that are part of the LC panel. Since one RGB LED cluster has three LEDs, the these three LED need to be driven for each region.

The electronic circuitry is designed accordingly. The electronic circuitry includes drivers for the LCD and drivers for the LEDBK. The drivers for the LCD contain the picture information needed to create a desired image on the LC panel. The drivers of the LEDBK, need a subset of the corresponding information to light up the corresponding LED in the region.

The display device of the present embodiment may be seen as an LCD TV, where the LC panel 90 is a screen of the LCD TV and the LEDBK panel 80 is its corresponding backlight panel. If part of the TV picture, e.g., region A1, is blue sky, then the blue LED within the cluster for region A1 is turned on. In the same scene, if the region B3 needs to display a green field, then the green LED in the cluster for region B3 is turned on. Yet in another region all three LEDs may be turned on to provide a white light to provide a more complicated image. Similarly, in a frame by frame of the TV image, the LEDs in the regions of the LEDBK panel 80 may be driven frame by frame.

If no image is in a frame the LEDBK LEDs are turned off. In the present embodiment, the backlight is selectively turned on or off at different regions as desired, thus saving energy when compared to prior art. Accordingly, the operating life of the LCD type may be increased and also reduce the temperature of the LCD TV.

For cell phones applications, if just telephone numbers are displayed, e.g., regions A1 and A2, of the panel 90, then the LEDs in those regions may be turned on while the LEDs in other regions are turned off.

For TV applications, where the frames are refreshed typically at 30 frames per second, the LEDs are turned off and on at the corresponding rate generally. However if part of the video of the image does not change in some frames, then the LEDs in those regions may be kept turned off or on, which results in further energy saving.

In an LCD TV application of 19" TV, the display panel may be made using 192 regions, composed of 12 rows and 16 columns. This would require 192 RGB clusters in total, or 576 LEDs. In a large LCD TV, lets say 40" in size, the display panel may be divided into 20000 regions, 100 rows and 200 columns. This panel would use 60000 LEDs in the present embodiment, which would result in a significant picture quality improvement when compared with state of the art 40" LCD TV.

In one embodiment, the LED cluster may have different configuration than RGB, e.g., RGBB, with four LEDs in a cluster or RGBCY with five LEDs per cluster, (with additional Cyan and yellow LEDs). Any other combination of color LEDs can be arranged in a cluster to create the desired color effect for the human eye.

Although the backlighting panel can be constructed with same LED cluster throughout (herein referred to as "uniform LEDBK"), the panel may have a non-uniform LEDBK, where clusters of different LED combinations can be placed in different regions of the LEDBK to create the desired color, resolution, contrast or brilliance effect. For example, the edges of the LCD where the human eye generally does not focus onto, especially when viewing a large screen TV, the LED clusters of the LEDBK can be composed only with single white LED in these edge regions. On the other hand, the RGB LED clusters may be provided at the regions in the central viewing area of the screen. Alternatively, the peripheral or edge regions of the LEDBK are provided with RGB LED clusters, and the central viewing area are provided with more colorful RGBB or RGBCY LED clusters. Other combination of LEDs may be used according to application.

Figure 3:
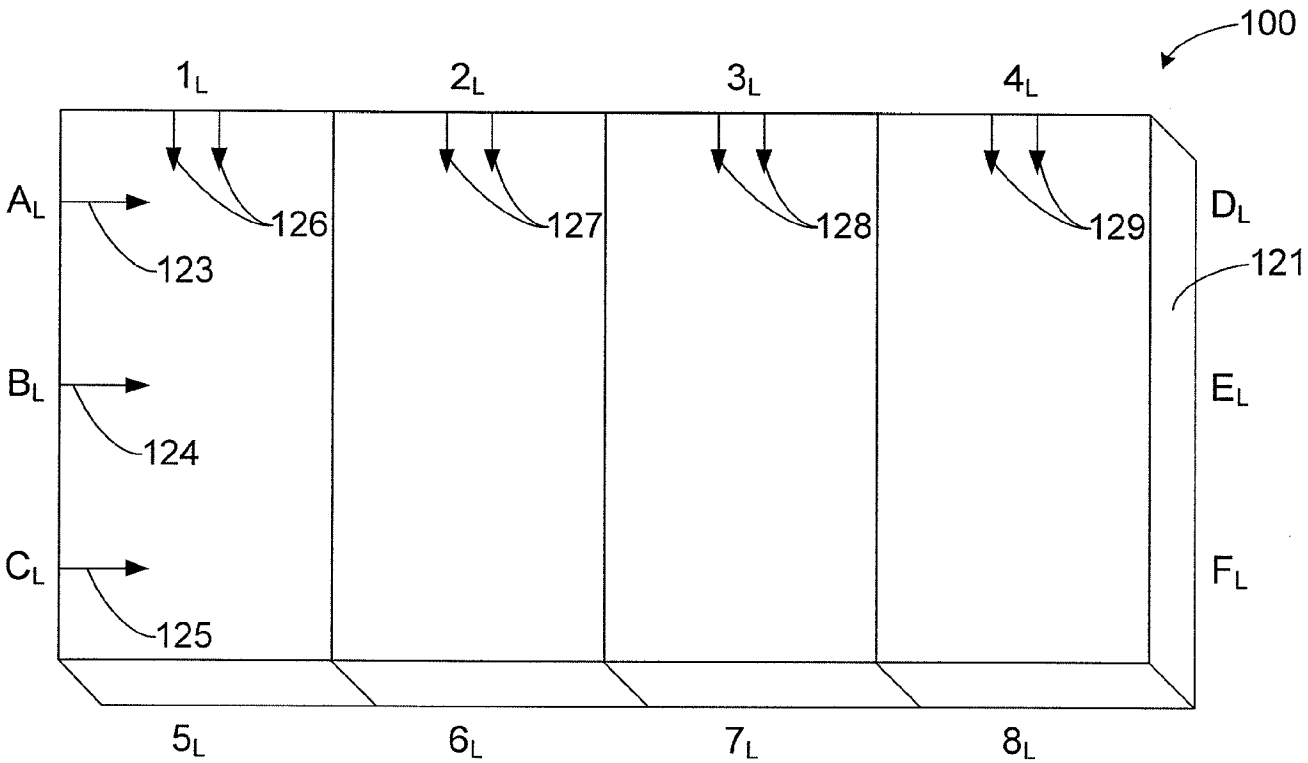
FIG. 3 illustrates a portion of the LEDBK for simplicity of illustration.

FIG. 3 illustrates a portion 100 of the LEDBK 80 for simplicity of illustration. The portion 100 has 12 regions, 4 columns (1 to 4) and three rows (A to C). A light diffuser layer made of glass or polymer is placed on top of the LED array and is part of the LEDBK panel. In one implementation, each region had a single RGB LED cluster, thereby providing LEDs in a matrix format. As before the image is either a picture or video in a TV application, or data or telephone numbers, or a picture or video in a typical mobile phone or PDA application.

According to an embodiment of the present invention, one can also design a display with a mode where the image can be created by the LEDBK LEDs without the image creation of the LC panel. This is effective when there is no image to be presented by a video signal, or any image by the LC panel. Namely the LC panel is in a transparent mode, letting the backlight through. It can be used for text, instruction, or data presentation, where the LEDs of the LEDBK are creating the image. This tends to be a lower resolution image but quite bright.

In one embodiment, the LED configuration of one, two, three, or four arrays are used to reduce the number of LEDs in the LEDBK and save manufacturing cost. The array may be a vertical array or a horizontal array or a combination thereof. In a 3-by-4 matrix, 12 LED clusters would bee needed in a matrix configuration. However in an array configuration of one type, the total of 7 LED clusters are used. Three LED clusters $A_L$, $B_L$, and $C_L$ are provided in a column left side array. Four LED clusters $\mathbf{1}_L$, $\mathbf{2}_L$, $\mathbf{3}_L$, and $\mathbf{4}_L$ are provided as a top array. In one embodiment, a single LED may be used instead of an LED cluster.

The three LED clusters $A_L$, $B_L$, and $C_L$ illuminate along the general horizontal direction as shown by the arrows 123, 124, and 125. The LED clusters $\mathbf{1}_L$, $\mathbf{2}_L$, $\mathbf{3}_L$, and $\mathbf{4}_L$ illuminate vertically down as shown by arrows 126, 127, 128, and 129. The LEDs illuminate into a light guide or light diffuser 121 that is made from glass, or a transparent polymer, plastic etc. The light guide distributes the light and spreads it over the panel. The placement of the LED clusters and their intensity may be modified to obtain more light uniformity in the panel. For example, an array of LED clusters $D_L$, $E_L$, and $F_L$ may be added at the right vertical side and/or an array of LED clusters $\mathbf{5}_L$, $\mathbf{6}_L$, $\mathbf{7}_L$, and $\mathbf{8}_L$ may be added at the bottom horizontal side. To keep the light intensity at region A1 and region B2 generally equal, the drive to LEDs $A_L$ and LEDs $\mathbf{1}_L$ may be modified LEDs $B_L$, and LEDs $\mathbf{2}_L$ accordingly.

Figure 4:
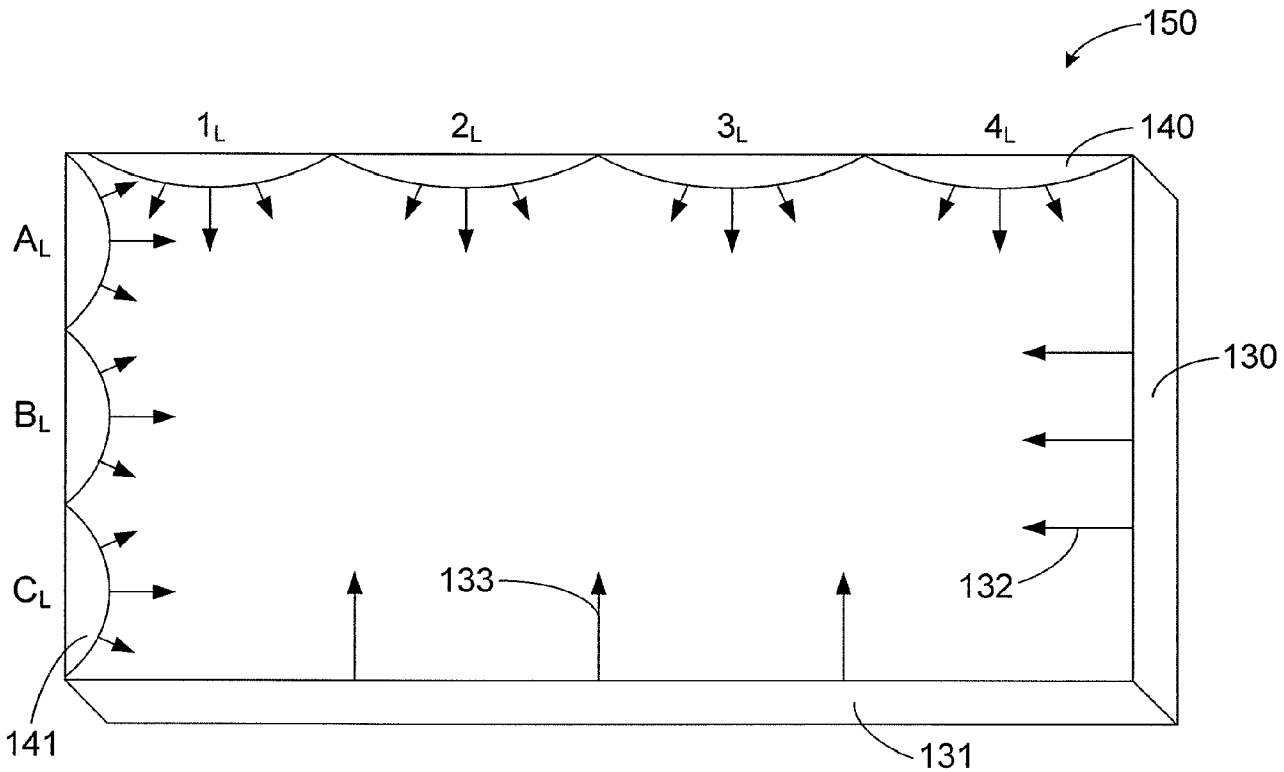
FIG. 4 illustrates a LEDBK having a light guide panel according to one embodiment of the present invention.

FIG. 4 illustrates a LEDBK 150 having a light guide panel 130 according to one embodiment of the present invention. Edges of the light guide panel 130 are shaped like divergent lenses 140 and 141 to spread the light from the LEDs into the guide. If only 7 LED clusters are used, the lens light collecting and distribution shape are formed in the areas corresponding to the locations of the LED clusters. Coated mirrors 131 are provided at the opposite sides to the LEDs, so that the light would be reflected back into the light guide panel as shown by arrows 132 and 133.

According to the teachings of the present embodiment, different light intensities and different colors can be controlled for the 12 regions of the LEDBK panel using 7 LEDs. In bigger displays, the advantage of using the LEDs in an array configuration would be more pronounced. For example, a display defining 10 rows and 15 columns will need 150 LED clusters under a matrix configuration However, as little as 25 LED clusters may be used under an array configuration described above. If the LED clusters are added on the right and bottom sides, only 50 LED clusters would be needed, which is ⅓ of the LED clusters needed under the matrix configuration.

Figure 5:
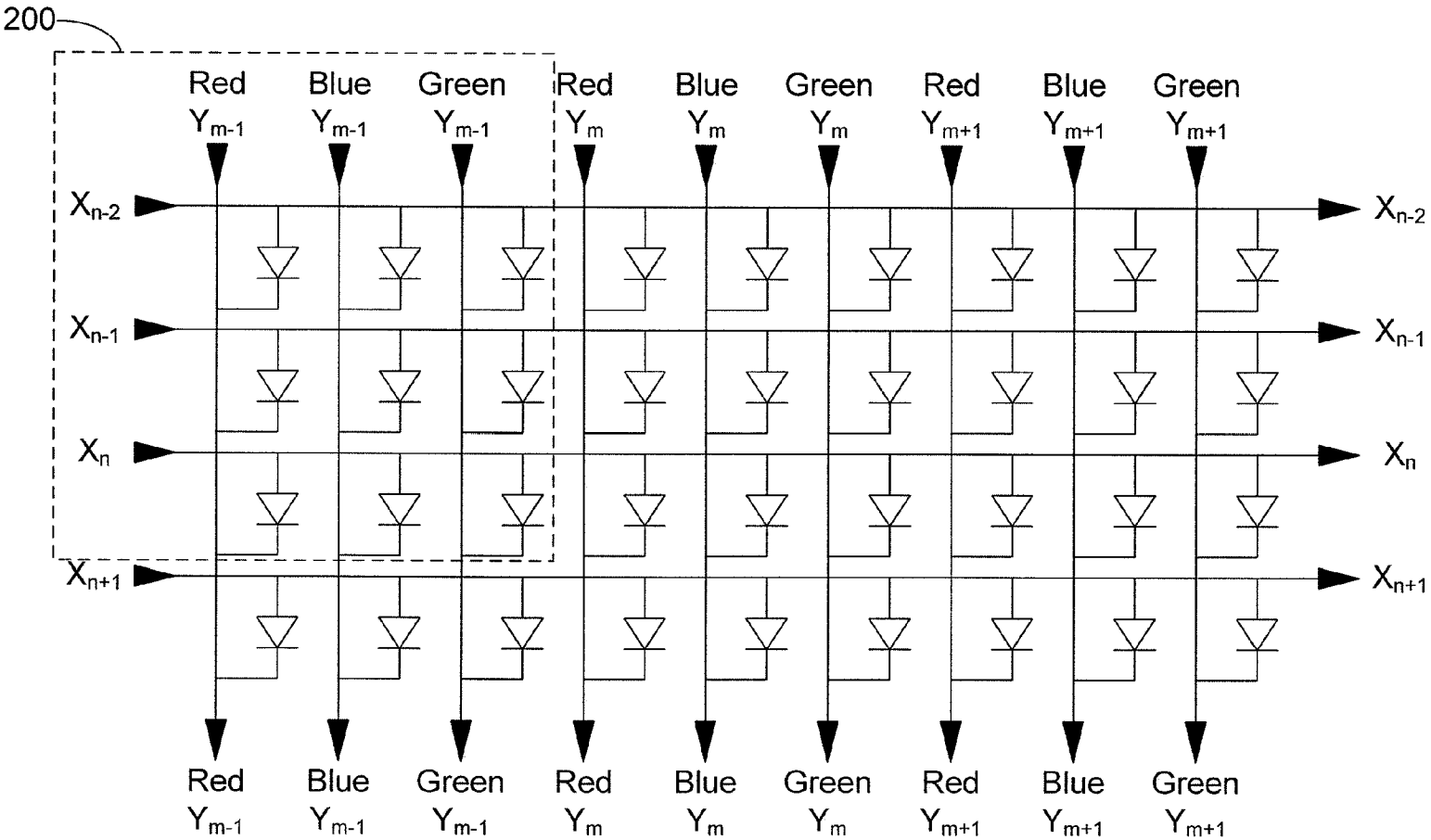
FIG. 5 illustrates an array of 12 LED clusters (Xn−2,Ym−1) to (Xn+1,Ym+1) in a matrix configuration according to one embodiment of the present invention.

FIG. 5 illustrates an array of 12 LED clusters (Xn−2,Ym−1) to (Xn+1,Ym+1) in a matrix configuration according to one embodiment of the present invention. These 12 LED clusters are provided for the 12 regions defined on a LEDBK panel. Each region has RGB LEDs. Each LED connected to a column line and a row line corresponding to its coordinate.

Figure 6:
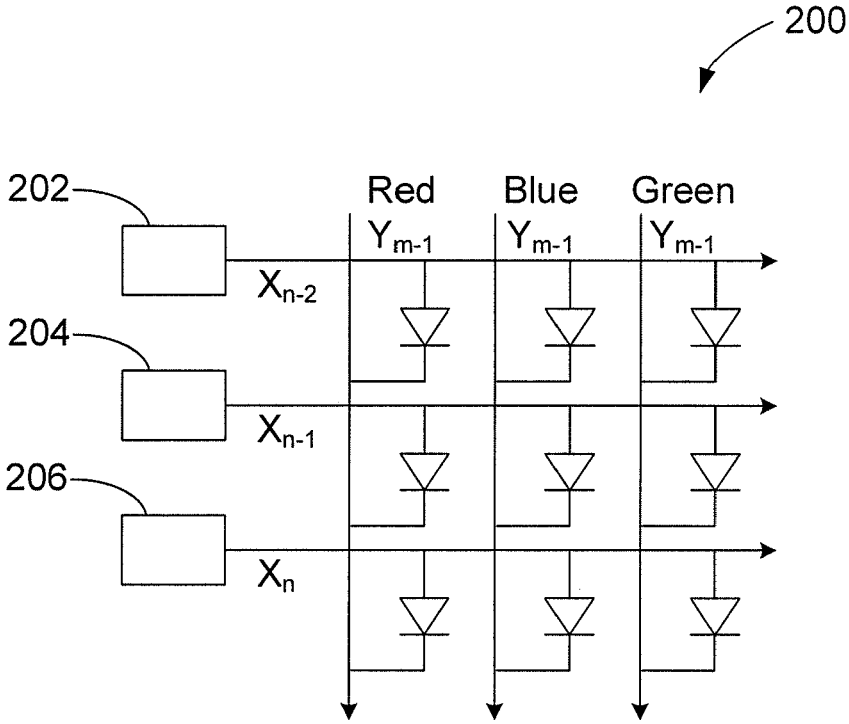
FIG. 6 illustrates a portion of the matrix configuration of FIG. 5 according to one embodiment of the present invention.

FIG. 6 illustrates a portion 200 of the matrix configuration of FIG. 5 according to one embodiment of the present invention. A driver is provided for each line to provide current/voltage. For example, row drivers 202, 204, and 206 are provided for lines Xn−2, Xn-1, and Xn, respectively.

Figure 7:
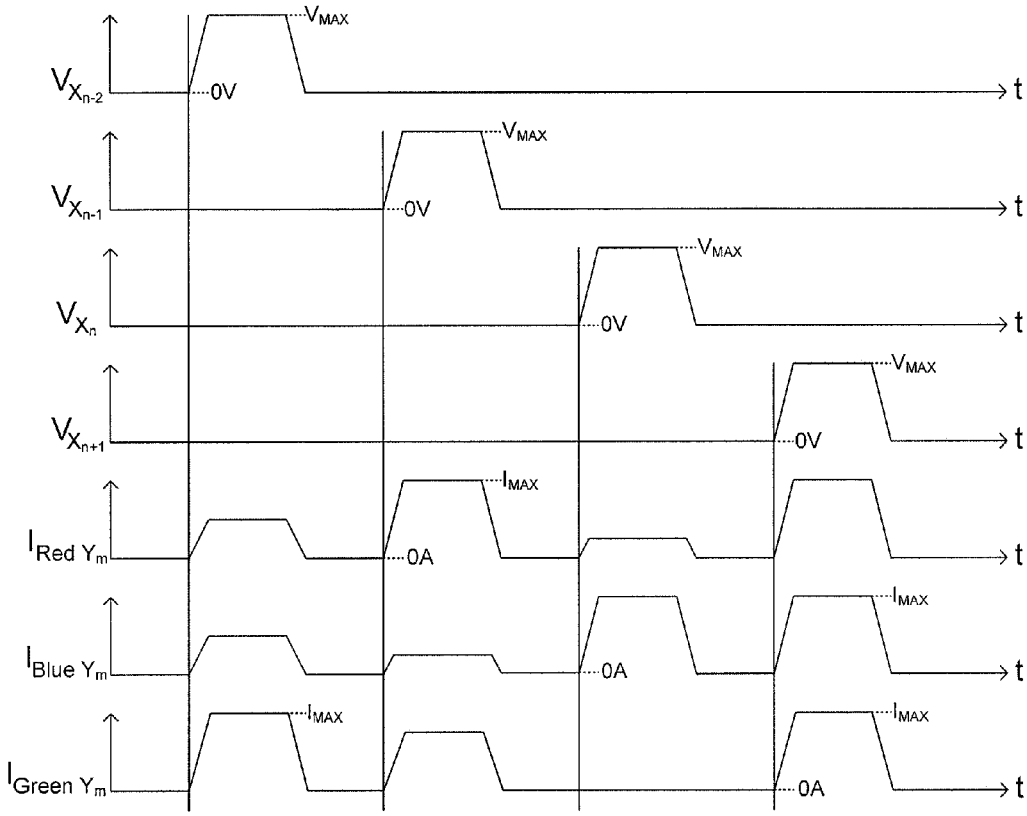
FIG. 7 illustrates waveforms associated with driving the 12 LED clusters in FIG. 5 according to one embodiment of the present invention.

FIG. 7 illustrates waveforms associated with driving the 12 LED clusters in FIG. 5 according to one embodiment of the present invention. As shown, the LED cluster (Xn−2, Ym) is first powered, then followed by (Xn−2,Ym−1), then by (Xn−2,Ym), and then by (Xn−2, Ym+1) in sequence. The row driver 202 drives VMAX to all of the LED cluster anodes connected to the line Xn−2 to enabling all three colors. Once enabled, a current applied to IRed Ym, IBlue Ym, or IGreen Ym will turn on the respective LEDs in the clusters. The actual light output of the LED is proportional to the current sunk by the respective Ym.

Figure 8:
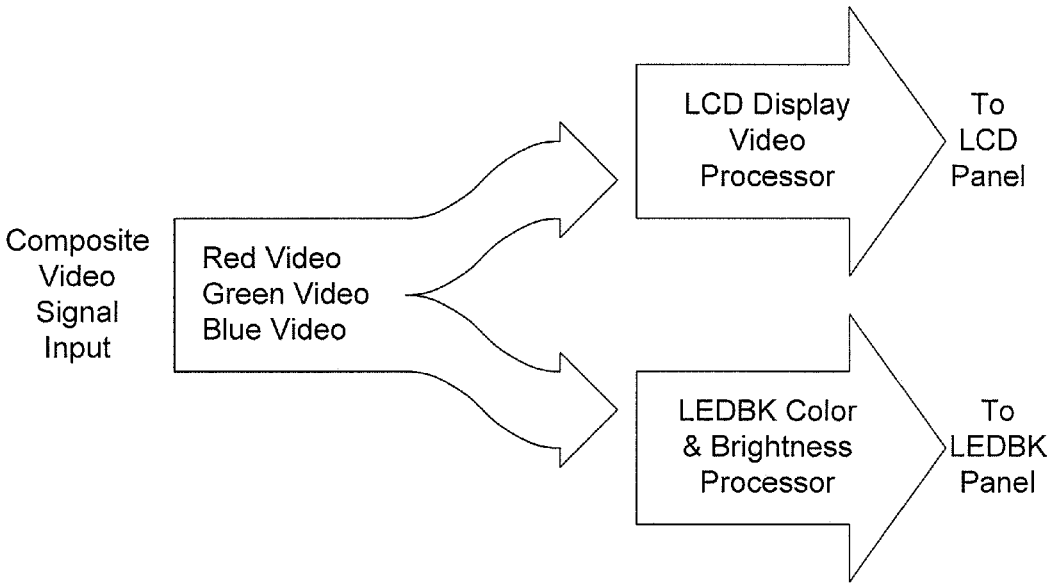
FIG. 8 illustrates signals used to generate images on a display panel according to one embodiment of the present invention.

FIG. 8 illustrates signals used to generate images on a display panel according to one embodiment of the present invention. In the present embodiment, the same composite video signal for the LCD panel is used to create the drive signals needed by the LEDBK. The LCD panel control circuitry may take advantage of the variable light output levels and colors of the LEDBK to improve observed contrast, color brightness, and still reduce overall backlight power consumption.

Figure 9:
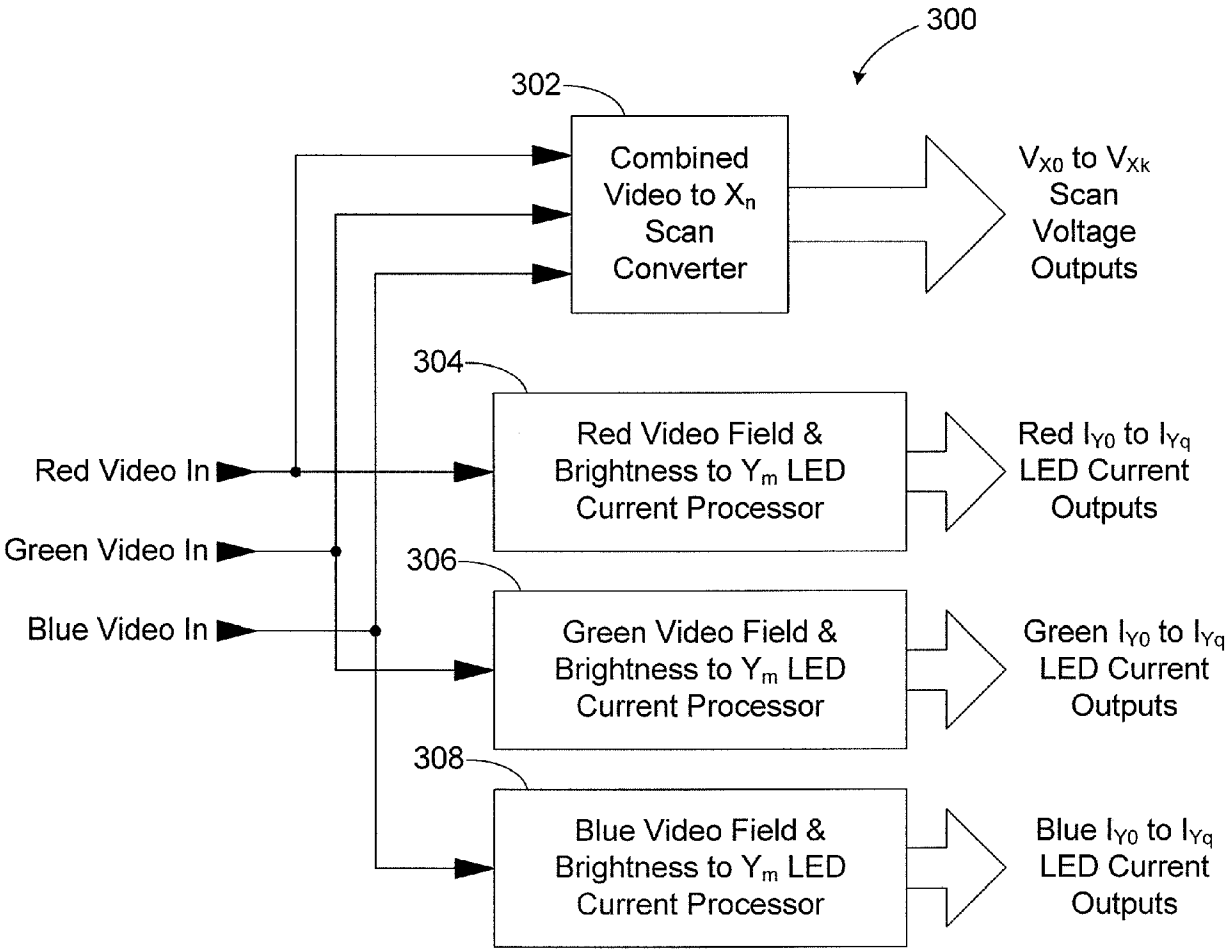
FIG. 9 shows a block diagram of a decoder circuit 300 that is used to create the signals shown in FIG. 6.

FIG. 9 shows a block diagram of a decoder circuit 300 that is used to create the signals shown in FIG. 6. An Xn scan converter 302 creates the row timing signals that correspond to the image displayed on the LCD panel, so that the brightness and color information needed by the LCD is matched to the correct LED cluster. Red, Green, and Blue video-in signals are provided to the Xn scan converter 302. The red video-in signal is provided to a processor 304 that outputs current to Red LEDs. The green video-in signal is provided to a processor 306 that outputs current to Green LEDs. The blue video-in signal is provided to a processor 308 that outputs current to Blue LEDs. The variable current outputs of the respective red, green, or blue LED columns provide not just the brightness but the color perceived by the viewer. In the simplest implementation, a one-to-one correspondence between the LED backlight to the LCD panel may exist. In a more cost effective solution, it can be shown that the number of LED clusters can be reduced for a given number of LCD pixels by as much as 10 by using the fact that the human eye has approximately 10 times more rods, which are sensitive to light, than cones, which are sensitive to color.

The present invention has been described in terms of specific embodiments. As will be understood by those skilled in the art, the embodiments described above may be modified or altered without departing from the scope of the present invention.

What is claimed is:

1. A display comprising:

a display panel;

a backlight panel provided behind the display panel, the backlight panel having a plurality of regions each of the same size;

each of the plurality of regions having a set of light emitting diodes (LEDs) chosen from a plurality of colors of LEDs, and each one of the LEDs in each region being coupled to a current line and a voltage line;

wherein for each of the plurality of regions the set of LEDs in that region depends on where that region is located on the backlight panel to thereby provide a backlight panel in which at least some regions of the plurality of regions having a different set of colors of LEDs than other regions of the plurality of regions, thereby providing a backlight panel wherein the LEDs in some regions of the plurality of regions are different than the LEDs in other regions of the plurality of regions; and wherein the color of light emitted from each region of the plurality of regions is controlled by adjusting the current and voltage to the LEDs in that region.

2. The display of claim 1 wherein each of the plurality of regions comprises a pixel on the display.

3. The display of claim 2 wherein each of the pixels includes a red, a green and a blue LED.

4. The display of claim 3 wherein at least some of the pixels include a red, a green, a blue and another blue LED.

5. The display of claim 4 wherein at least some of the pixels include a red, a green, a blue, a yellow and a cyan LED.

6. The display of claim 1 wherein the plurality of regions include first regions at a periphery of the backlight panel and second regions proximate the center of the backlight panel and wherein the first regions and the second regions have different colors of LEDs from each other.

7. The display of claim 6 wherein each of the second regions have more LEDs than each of the first regions.

8. The display of claim 1 further comprising a light guide to spread the light emitted by the LEDs associated with some of the regions.

9. The display of claim 8 wherein the light guide includes a reflective surface opposite the side of the LEDs.

10. A backlight panel for a display comprising:

a plurality of first regions, each of a same first size, each first region having light emitting diodes (LEDs) on the backlight panel, each of the plurality of first regions having a first number of LEDs;

a plurality of second regions, each second region also being of the same first size, each of the plurality of second regions having LEDs on the backlight panel, each of the plurality of second regions having a second number of LEDs, the second number of LEDs being larger than the first number of LEDs;

each of the LEDs on the backlight panel being connected a current line and a voltage line; and wherein the color of the light emitted by each of the plurality of first regions and each of the plurality of second regions is controlled by adjusting the current in each current line and the voltage in each voltage line.

11. The backlight panel of claim 10 wherein each of the first regions include a red, a green, and a blue LED, and each of second regions include a red, a green, a blue, and at least one more LED in addition to the red, the green and the blue LEDs.

* * * * *